United States Patent [19]

Hobbins

[11] Patent Number: 5,060,896

[45] Date of Patent: Oct. 29, 1991

[54] FURNITURE ADJUSTMENT DEVICE

[76] Inventor: John C. Hobbins, Whistlers Farm House, Tangley, Nr. Andover, Hampshire SP11 0SB, United Kingdom

[21] Appl. No.: 435,396

[22] PCT Filed: May 6, 1988

[86] PCT No.: PCT/GB88/00359

§ 371 Date: Nov. 7, 1989

§ 102(e) Date: Nov. 7, 1989

[87] PCT Pub. No.: WO88/08682

PCT Pub. Date: Nov. 17, 1988

[30] Foreign Application Priority Data

May 8, 1987 [GB] United Kingdom ..... 8710988
Sep. 2, 1987 [GB] United Kingdom ..... 8720580

[51] Int. Cl.[5] ..... F16M 11/24
[52] U.S. Cl. ..... 248/188.2; 297/345
[58] Field of Search ..... 248/188.2, 188.8, 188.5, 248/188, 172, 161; 297/345

[56] References Cited

U.S. PATENT DOCUMENTS

| | | | |
|---|---|---|---|
| 1,549,144 | 8/1925 | Messegee . | |
| 2,107,629 | 2/1938 | Dallas . | |
| 2,722,970 | 11/1955 | Stechmann | 248/188.2 |
| 2,935,813 | 5/1960 | Berman et al. | 248/188.2 |
| 2,941,329 | 6/1960 | Apparius | 248/188.2 |
| 3,177,035 | 4/1965 | Halstrick | 248/188.2 X |
| 4,607,726 | 8/1986 | Davis et al. | 248/188.8 X |
| 4,807,720 | 2/1989 | Kim | 248/188.8 X |

FOREIGN PATENT DOCUMENTS

| | | |
|---|---|---|
| 971253 | 9/1964 | United Kingdom . |
| 1461588 | 1/1977 | United Kingdom . |

*Primary Examiner*—David M. Purol
*Attorney, Agent, or Firm*—Ware, Fressola, Van Der Sluys & Adolphson

[57] ABSTRACT

A device for adjusting the seat height (S) of a chair (2) comprising four leg extenders (A, B, C, D). Each has an aluminum extrusion leg extension member (11) with a rebate (12) for partially accommodating a leg (1) to be extended. Located at one of a plurality of slots (21) along the member, a leg end support (18) is engaged and located by a locking member (23). Above the support (18), an overcentre buckle clamp (39), clamps the leg (1) to its extension member (11).

13 Claims, 4 Drawing Sheets

FURNITURE ADJUSTMENT DEVICE

FIELD OF THE INVENTION

The present invention relates to a furniture adjustment device, particularly though not exclusively for use in adjusting the seat height of a child's chair.

BACKGROUND OF THE INVENTION

Childrens high chairs are well known, not only the type incorporating a tray for support of the child's plates, but also the type which are in effect long legged chairs. With the latter type, a child sits at a table in the normal way but lifted up to a height suitable for the child to eat comfortably from a plate on the table. In due course a child grows out of his high chair and yet is too small to sit comfortably on an ordinary chair.

At this stage the child is often sat on a cushion on an ordinary chair to lift him to a suitable height However, this is seldom a convenient arrangement, in particular because the cushion tends to push the child too far forward or back, and the cushion may slip onto the floor. Also the cushion usually gets dirty from the child's sticky fingers British patent specification No. 971,253 describes an adjustable seat for a child for use in a car. It has telescopically adjustable legs for adjusting the height in the car at which the child is seated. However such telescopic adjustment is provided as an integral part of the seat. Telescopic adjustment cannot readily be introduced into an existing chair, which may have legs with a widely varying diameter and cross-section.

British patent specification No. 1,461,588 describes an adjustable furniture support which comprises upright members for housing wooden blocks on which rest the legs of a piece of furniture to be moved. The support is not connected to the piece of furniture in any permanent manner, rendering it unsuitable for a chair which is to be moved regularly.

THE INVENTION

The object of the present invention is to provide a device with which the height of an ordinary chair can be adjusted upwards leaving the chair readily movable, for instance for supporting a young child at a height convenient for the child to eat comfortably and to be moved into the table as necessary.

A furniture adjustment device of the invention comprises a plurality of leg extenders, each leg extender having an elongate leg extension member and a support intermediate its ends for supporting the bottom end of a furniture leg to extend it by the distance in the extender from the support to a lower end of the leg extension member; each leg extender further comprising a clamp for clamping the leg extension member to the leg above the support to secure the extender to the leg.

Each support may be fixed permanently to its extender, preferably eccentric to its length, whereby a different degree of seat height adjustment is achieved according to which way up the extender is arranged. Alternatively, as preferred, each support is adjustable along its extender, conveniently between discrete positions.

Preferably each leg extension member has a plurality of laterally open recesses providing the discrete positions and spaced along its length and its support has at least one tongue for engagement in a selected one of the recesses. Each extender may include a locking member laterally retained on and axially slidable along its leg extension member into discrete positions corresponding to the discrete positions of the recesses for restraining lateral movement of its support and withdrawable therefrom for disengagement of the tongue(s) from the selected recess(es).

THE DRAWINGS

To help understanding of my invention a specific embodiment thereof will now be described by way of example with reference to the accompanying drawings.

THE PREFERRED EMBODIMENT OF THE INVENTION

Figure 1:
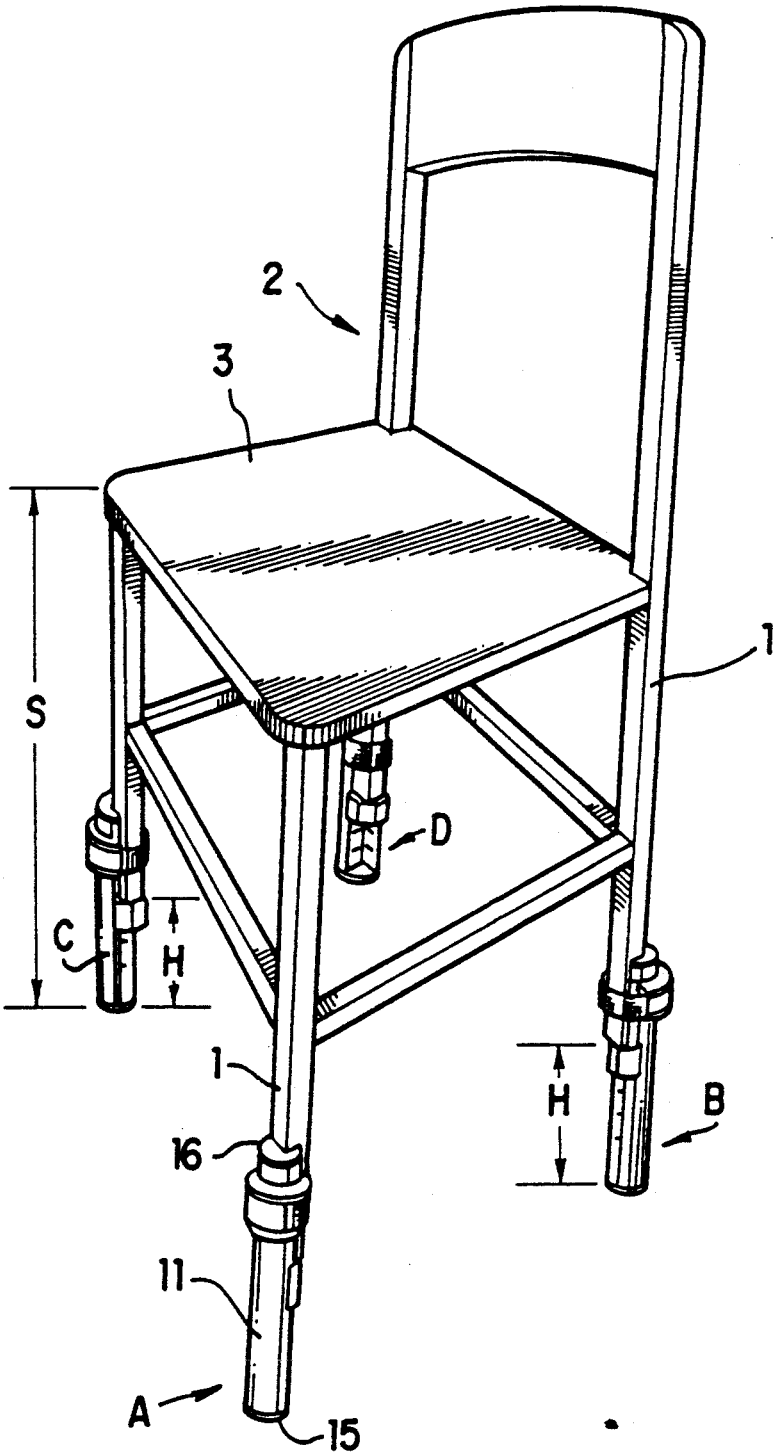
FIG. 1 is a perspective view of a chair having a furniture adjustment device of the invention fitted to it.

Referring to FIG. 1, the furniture adjustment device thereshown consists of four identical leg extenders A,B,C,D. By supporting the bottom ends of the legs 1 of a chair 2 at a height H above the floor, the height S of the seat 3 of the chair is raised by a corresponding amount.

The four leg extenders are identical and one only will now be described in detail.

Figure 4:
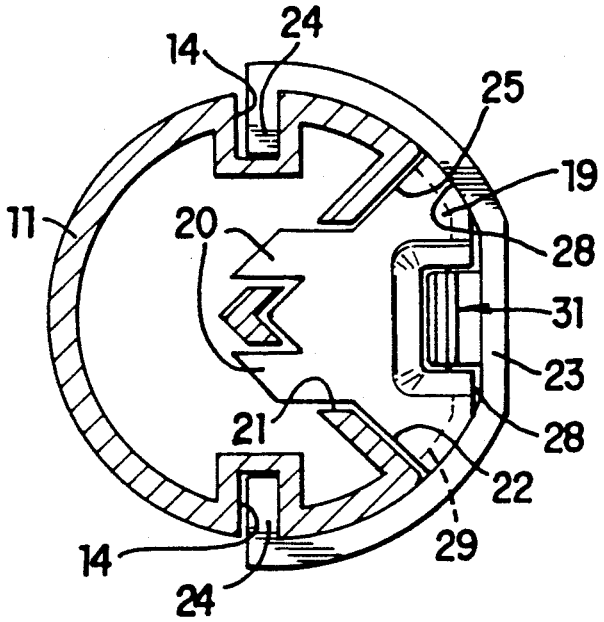
FIG. 4 is a cross-sectional plan view on the line IV—IV in FIG. 2.
Figure 5:
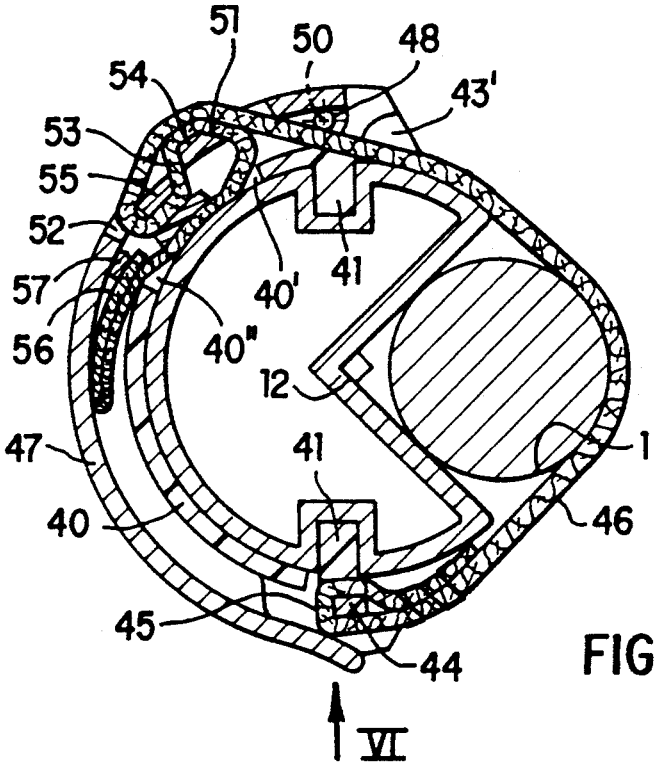
FIG. 5 is a cross-sectional plan view on the line V—V in FIG. 2.
Figure 6:
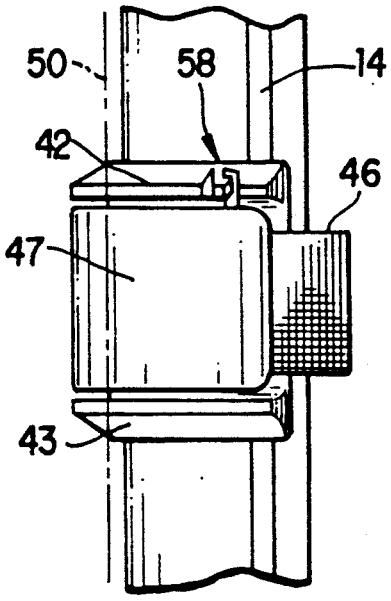
FIG. 6 is a scrap side view in the direction of the arrow VI in FIG. 5.

The illustrated leg extender has a leg extension member 11 in the form of an aluminium extrusion, whose cross-sectional shape is best seen in FIGS. 4 & 5. The extrusion is generally circular cylindrical except that in one side a concave right angle rebate 12 is provided. Diametrically positioned with respect to each other and positioned on opposite sides of the rebate 12 are guide grooves 14.

Figure 2:
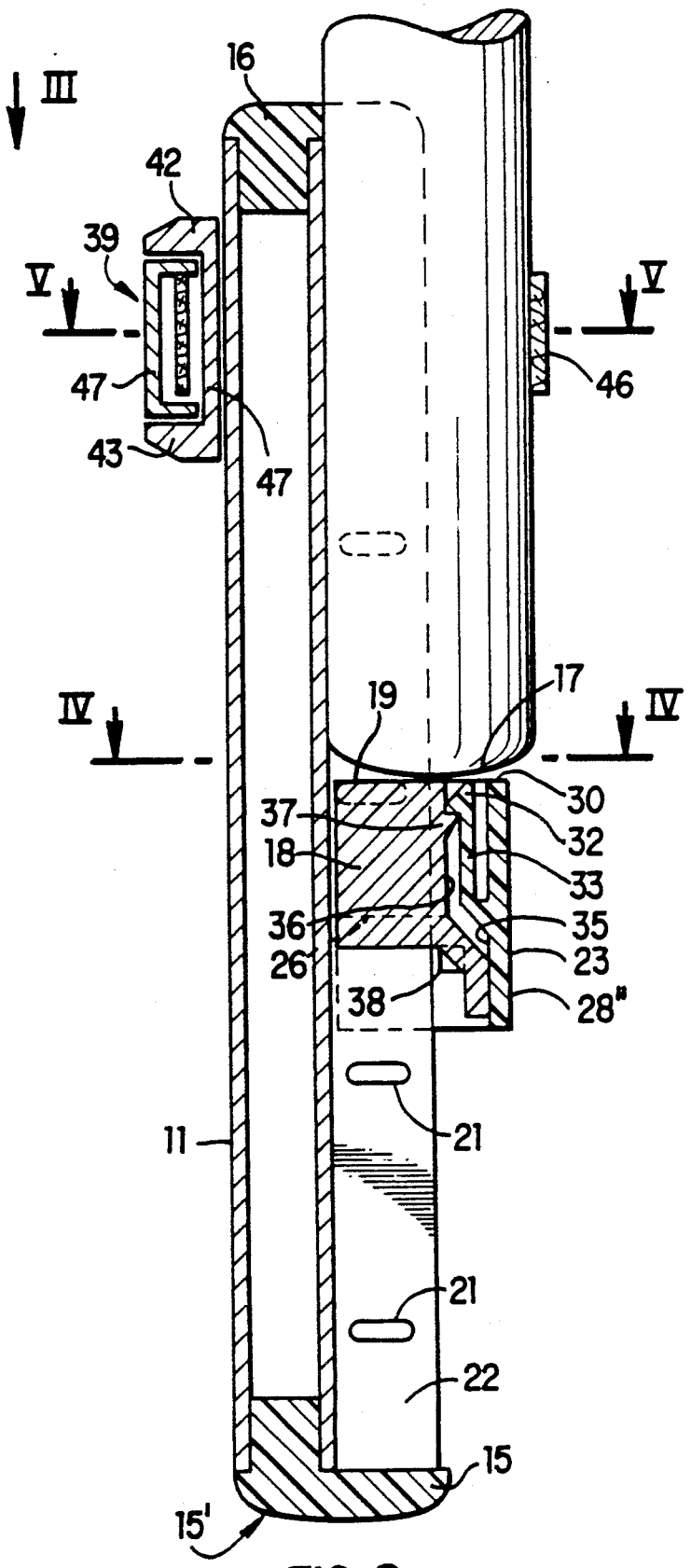
FIG. 2 is a cross-sectional side view of a leg extender of the invention, the cross-section being on the line II—II in FIG. 3.
Figure 3:
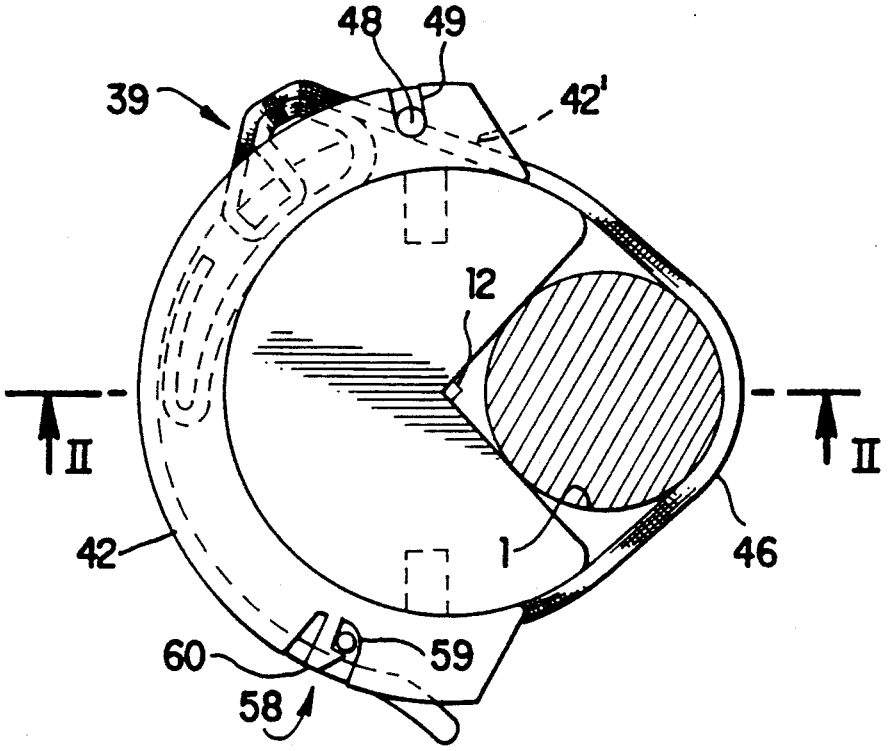
FIG. 3 is a top plan view on the direction of the arrow III in FIG. 2.

As may be seen in FIG. 2, the leg extension member is plugged at the lower end by a moulded plastics material cap or foot 15. This is of segmented circular cross-section to close the rebate 12 and spreads the load from the leg extender to a floor via a curved end surface 15'. The top of the extension member is similarly plugged by a top cap 16 having a cross-sectional shape complementary to that of the extrusion 11, including the rebate 12.

The bottom of a leg 17 is supported on a support 18, which is a light alloy die casting. A flat top surface 19 of the support has two tongues 20 which fit into a selected one of a number of pairs of slots 21 in the right angle faces 22 of the leg extension member 11. The support is retained in position by a locking member 23. This is of moulded plastics material shaped to engage the outer contour of the leg extension member 11 and engage in the guide grooves 14 via lips 24.

From the flat top surface 19 and the tongues 20 of the support, two flat back surfaces 25 extend down for abutment with the faces 22 of the leg extension member. The back surfaces curve away at level 26 from the faces 22 at their lower edges to allow the support 18 to pivot about the level 26 for withdrawal of the tongues 20 from the slots 21. This pivoting is possible when the locking member 23 is withdrawn downwards. The support has a part-circularly-curved outer-side surface 28 extant at its top surface 19 and the bottom level 26 in the form of a top step portion 28' and a lower stop/extension portion 28". Between these, the surface 28 is cut away to provide a shallow recess 29 of a depth equal to the extent of the tongues 20 from the back surface 25. When the locking member 23 is withdrawn down, the top step portion 28' is clear of the upper edge 30 of the locking member, which is in the form of a thin shell. Thus the support 18 can be pivoted out about the level 26 to withdraw the tongues, with the upper edge 30 being received in the shallow recess 29.

To guard against accidental withdrawal of a locking member, a catch 31 is provided. This consists of an angled, knurled detent 32 provided at the top of a resilient web 33 rooted at an abutment 34 on the inside surface 35 of the locking member. The catch 31 is received in a longitudinal recess 36 deeper than the recess 29. At the level of the upper step 28', the recess 36 has a triangular section rib 37. When the locking member 23 is in its locking position, the flat under-surface of the detent 32 rests on the flat upper surface of the rib 37. Thus the parts are held in position. For withdrawal of the locking member, the knurled upper surface of the detent is drawn out disengaging the detent from the rib. The locking member can then be withdrawn downwards until the abutment 34 touches the bottom end of the deep recess 36. For re-engagement, the locking member is lifted until the angled (and knurled) upper surface of the detent 32 strikes the angled under-surface of the rib 37. The detent rides over the rib and springs over it for engagement. To prevent further upwards movement of the locking member 23 with respect to the support 18, the inside surface 35 of the locking member is provided with a stop 38 which co-operates with the underside of the support 18. Thus the locking member can be moved through a limited distance with respect to the support between an upper, engaged position and a lower, withdrawn position. However when the tongues 20 are withdrawn from the slots 21, the locking member and support can be moved together along the length of the leg extension member 11.

The leg extender has an over-centre, buckle clamp 39 for clamping the leg 1 into the rebate 12. The clamp has a plastics moulded body 40 shaped to the outer contour of the leg extension member 11 and having lips 41 engaging in the guide grooves 14 whereby when the clamp is released the body 39 can be moved up and down the leg extension member 11 without becoming separate from it. The body has upper and lower rims 42,43 extending radially of the extrusion. At one side of the body a strap-end-securing bar 44 extends between the rims as an integral part of the moulded body (20). The bar 44 is surrounded by a loop 45 provided at an end of a webbing strap 46 by stitching its end back on itself. The strap 46 passes round the leg 1 on the opposite side from the clamp and returns to a buckle member 47. This is a steel stamping having pressed in pins 48. These pins snap into complementary recesses 49 in the rims 42,43 at the opposite end thereof from the bar 44. The recesses define a pivot axis 50 for the buckle member 47.

The buckle member 47 is curved to fit between and follow the rims 42,43 round the clamp body 40. At the pins 48, the member 47 is flanged inwards to carry the pins. At this end between the pins, the member 47 is recessed and defines a strap control edge 51 on a bar 54.

Inwards of the strap control edge 51 of its bar 54, two apertures 52,53 are stamped providing both the bar 54 and a further bar 55: Both bars are arranged parallel to the axis 50 in the manner of a ladder. The webbing strap 46 is threaded in a S configuration around the bars 54,55, that is from the run of it passing around the leg 1, the strap 46 passes over the control edge 51, in through the aperture 52 further from the edge 51, around the further bar 55, out through the second slot 53, around the bar 54 providing the strap control edge 51 between it and the outer run of the strap and back under the buckle member 47. Here it passes through a first slot 40' in the body and back through a second slot 40". The free end 56 of the strap is controlled by doubling it back under a bar 57 extending between the rims 42,43.

To secure the clamp, the buckle member 47 is pivoted away from the body 40 about the pins 48 into a position abutting stops 42',43' at the ends of the rims. The length of the strap from the bar 44, around the leg 1, to the strap control edge 51 is adjusted by passing more or less of the strap through the apertures 52,53 and slots 40',40" as necessary. With the buckle member 47 positioned against the stops 42',43' the strap is tightened. Then the buckle member 47 is closed to the body 40. This tensions the strap about the leg 1. The outer run of the strap over the control edge 51 compresses the inner run against the edge thus securely gripping the strap to the buckle member. During the last portion of the closure movement, the run of the strap passes from without to just within the axis 50, i.e. it passes over-centre and tends to keep the buckle closed. The position of the strap control edge, allowing for the double thickness of strap on it, is important to achieve this over-centre action. Ribs inherent in the weave of the strap assist in slip resistant tightening of the strap.

To avoid accidental release of the buckle member 47, a resilient catch 58 is moulded integrally with the body 40 at rim 42 to engage a peg 59 on the member 47 in its closed position. The catch is deflected by means of a ribbed protrusion 60 on it for intentional release of the buckle member 47.

For use, the increase in height H of the seat 3 of a chair 2 to be raised is determined. The four leg extenders are all adjusted by setting their supports 18 to this height above the feet 15—or the nearest dimension in accordance with the position of the slots 21. This is done by withdrawing the locking members 23, sliding the supports 18 along the leg extension members 11 to engage the tongues 20 in the selected slots and repositioning the locking members in their locking position with the detents 32 engaged with the ribs 37. The buckle clamps 39 are then moved to mid-position between the supports 18 and the top end of the leg extension members. The buckles are opened and the straps 46 adjusted to a length to suit the legs 1. The buckles are closed with the legs 1 clamped into the rebates 12 and the bottom end of the legs on the supports 18.

VARIANT OF THE PREFERRED EMBODIMENT

Figure 7:
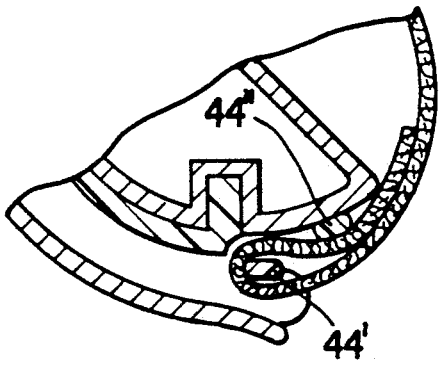
FIG. 7 is a view of an alternative strap end fitting.

The invention is not intended to be restricted to the details of the above described embodiment. For instance, as illustrated in FIG. 7, the fixed end of the strap 46 may be adjustable by threading it around two bars 44',44" in a modified S configuration, as with the buckle end of the strap except that the free end of the strap passes out to lie against the leg 1. Again, with adjustment provided at the fixed end, it may be unnecessary to attach the strap adjustably to the buckle member.

It should be noted that although my leg extender is primarily intended for a furniture adjustment device, I envisage that it may be useful for extending elongate members other than furniture legs.

I claim:

1. A furniture adjustment device for extending the legs of a piece of furniture, the device comprising for each leg a respective leg extender, each leg extender having:

an elongate leg extension member, having a rebate extending along its length for at least partially accommodating its leg and a lower end for abutting the floor and further having a plurality of laterally open recesses spaced along its length;

a support in the rebate of the leg extension member intermediate its ends, on which a bottom end of the furniture leg can rest to extend it by a distance in the extender from the support to a lower end of the leg extension member, the support having at least one tongue for engagement in a selected one of the recesses thereby being adjustable between discrete positions along the length of the leg extension member;

a clamp for clamping the leg extension member to the leg above the support to secure the extender to the leg, the clamp having a leg gripping member extending across the rebate at a position between an upper end of the elongate extension member and the support to grip the leg and clamp it into the rebate and to restrain pivoting of the extender with respect to the leg by providing abutment of the leg with the elongate member in the rebate both above the leg gripping member and below it; and a locking member laterally retained on and axially slidable along its leg extension member into discrete positions corresponding to the discrete positions of the recesses for restraining lateral movement of its support and withdrawable therefrom for disengagement of at least one tongue from the selected recesses.

2. A furniture adjustment device as claimed in claim 1, wherein each support locking member includes a resilient catch engageable with its support, when the locking member is in its restraining positions, and manually releaseable therefrom for withdrawal of the locking member from its restraining positions.

3. A furniture adjustment device as claimed in claim 2, wherein each support locking member is captive to its support and withdrawable longitudinally from its restraining positions only sufficiently to allow the support to be disengaged from the selected recess for movement of the support and locking member together to another recess.

4. A furniture adjustment device as claimed in claim 3, wherein each support has an outer surface abutting an inner surface of its locking member in the latter's restraining positions, the said outer surface having a relieved portion alignable with the inner surface of the locking member when the latter is withdrawn to permit disengagement of the support from its leg extension member.

5. A furniture adjustment device as claimed in claim 4, wherein the recesses are provided in pairs and a pair of the tongues is provided for engagement of the latter pair in a selected one of the pair of recesses, the rebate of each elongate leg extension member is angular and the member comprises a pair of elongate grooves on opposite sides of the rebate; each support comprises a body shaped to fit the rebate, having a lower part and an upper part and adapted to pivot about the lower part of the body for disengagement of the said pair of tongues which are provided on the upper part of the body from one of the pairs of recesses which are arranged on respective faces of the rebate; and each support locking member comprises a pair of lips received in respective ones of the grooves for laterally retaining the locking member on its leg extension member; the lower part of the support body covered by the locking member whether the latter is in its restraining or its withdrawn positions and the upper part of the body being covered by the locking member when in its restraining positions and being uncovered by the locking member when in its withdrawn positions.

6. A furniture adjustment device for extending the legs of a piece of furniture, the device comprising for each leg a respective leg extender, each leg extender having:

an elongate leg extension member, having an elongate leg-receiving angular rebate extending along its length for at least partially accommodating its leg and a lower end for abutting the floor and a pair of elongate grooves on opposite sides of the rebate;

a support in the rebate of the leg extension member intermediate its ends, on which a bottom end of the furniture leg can rest to extend it by a distance in the extender from the support to a lower end of the leg extension member; and a clamp for clamping the leg extension member to the leg above the support to secure the extender to the leg, the clamp having a leg gripping member extending across the rebate at a position between an upper end of the elongate extension member and the support to grip the leg and clamp it into the rebate and to restrain pivoting of the extender with respect to the leg by providing abutment of the leg with the elongate member in the rebate both above the leg gripping member and below it, the clamp being an over-centre buckle clamp having a clamp body radially retained on its leg extension member and axially slidable therealong for adjustment of its position between the upper end of the elongate member and the support and a strap providing its leg gripping member, the clamp body comprising a pair of lips received in respective ones of the grooves for laterally retaining the clamp body on its leg extension member; the clamp body extending peripherally around the leg extension member oppositely from the rebate.

7. A furniture adjustment device for extending the legs of a piece of furniture, the device comprising for each leg a respective leg extender, each leg extender having:

an elongate leg extension member, having a rebate extending along its length for at least partially accommodating its leg and a lower end for abutting the floor;

a support in the rebate of the leg extension member intermediate its ends, on which a bottom end of the furniture leg can rest to extend it by a distance in the extender from the support to a lower end of the leg extension member; and a clamp for clamping the leg extension member to the leg above the support to secure the extender to the leg, the clamp having a leg gripping member extending across the rebate at a position between an upper end of the elongate extension member and the support to grip the leg and clamp it into the rebate and to restrain pivoting of the extender with respect to the leg by providing abutment of the leg with the elongate member in the rebate both above the leg gripping member and below it, the clamp being an over-centre buckle clamp having a clamp body and a strap providing its leg gripping member, the clamp including upper and lower rims of its body a buckle member pivotally connected to the upper and lower rims at a pivot axis and having the strap adjustably connected to the buckle member and a strap-end-securing means extending between the rims and to which one end of the strap is connected, the buckle member having a strap control point so positioned with respect to the pivot axis that the strap passes radially inwards of the pivot axis when the buckle is closed into a position lying adjacent the clamp body to tension the strap around and grip the leg being extended.

8. A furniture adjustment device as claimed in claim 7, wherein each buckle member includes ladder means for adjustable connection of the strap thereto, the ladder means having a bar and an adjacent first slot both parallel to the pivot axis, and the first slot being on a side of the bar opposite from the pivot axis, the strap being connected to the buckle member by passing around the first bar and through the slot.

9. A furniture adjustment device as claimed in claim 8, wherein the ladder means includes another bar parallel to the one bar and closer to the pivot axis and defining with the one bar a second parallel slot, the strap passing inwards through the first slot, under the one bar, out through the second slot over the other bar beneath the outer run of the strap therearound.

10. A furniture adjustment device as claimed in claim 9, wherein each clamp includes a strap-end-locating bar extending between the upper and lower rims intermediate the pivot axis and the strap end securing member, an end of the strap being tucked between the clamp body and the strap-end-locating bar.

11. A furniture adjustment device as claimed in claim 7, wherein the strap-end-securing means is a fixed member extending between the upper and lower rims, the strap being looped therearound and having its end attached back on itself.

12. A furniture adjustment device as claimed in claim 7, wherein the strap-end-securing means comprises two bars extending between the upper and lower rims as a ladder, a strap end being secured by being wrapped around the two bars, the strap end thereby forming an S shape.

13. A furniture adjustment device as claimed in claim 7, wherein each clamp includes a locking catch for locking the buckle member to the clamp body against accidental opening of the buckle.

* * * * *